US005749745A

United States Patent [19]

Flöther et al.

[11] Patent Number: 5,749,745

[45] Date of Patent: May 12, 1998

[54] ADAPTER CONNECTOR AND CAMERA ASSEMBLY EQUIPPED WITH SAID ADAPTER CONNECTOR

[75] Inventors: Werner Flöther; Gerhard Hohberg, both of Aalen, Germany

[73] Assignee: Carl-Zeiss-Stiftung, Heidenheim, Germany

[21] Appl. No.: 551,795

[22] Filed: Nov. 7, 1995

[30] Foreign Application Priority Data

Nov. 9, 1994 [DE] Germany ..... 9417946 U

[51] Int. Cl.[6] ..... H01R 13/627

[52] U.S. Cl. ..... 439/349; 439/352; 439/914

[58] Field of Search ..... 439/578, 579, 439/638, 263, 914, 349, 271, 352

[56] References Cited

U.S. PATENT DOCUMENTS

| | | | |
|---|---|---|---|
| 3,058,089 | 10/1962 | Seido | 439/578 |
| 3,319,548 | 5/1967 | Kottler | 439/914 |
| 3,671,922 | 6/1972 | Zerlin et al. | 439/352 |
| 3,793,610 | 2/1974 | Brishka | 439/352 |
| 3,852,790 | 12/1974 | Robinson | 354/145 |
| 4,054,352 | 10/1977 | Rudin | 439/638 |
| 4,368,940 | 1/1983 | Sugiura | 439/916 |
| 4,559,421 | 12/1985 | Lapke et al. | 439/638 |
| 4,797,121 | 1/1989 | Hayward | 439/579 |
| 4,824,399 | 4/1989 | Bogar et al. | 439/578 |
| 4,866,465 | 9/1989 | Gallegos | 354/126 |
| 5,603,630 | 2/1997 | Villain | 439/352 |

FOREIGN PATENT DOCUMENTS 1132904 11/1968 United Kingdom .

*Primary Examiner*—Hien Vu
*Attorney, Agent, or Firm*—Walter Ottesen

[57] ABSTRACT

The invention is directed to an adapter connector for connecting an insertable connector plug to a receiving socket. The adapter connector includes a body having an adapter socket defining a hollow cylinder for receiving the insertable connector plug therein. A clamping device presses in the hollow cylinder to tightly clamp the insertable connector plug therein. The body also has an adapter connector plug provided thereon to include an external cylinder with a projecting latch nose for insertion into the receiving socket.

9 Claims, 3 Drawing Sheets

ADAPTER CONNECTOR AND CAMERA ASSEMBLY EQUIPPED WITH SAID ADAPTER CONNECTOR

BACKGROUND OF THE INVENTION

Adapter connectors and especially electrical adapter connectors are known per se. Adapter connectors usually function to connect non-compatible connector plugs and/or sockets or they include circuit elements such as switches or filters and the like.

For a camera having a separate electronic flash device, it is conventional to provide a control cable for flash synchronization and to provide this cable with a connector plug which is inserted into a socket on that part of the camera containing the shutter, the housing or the objective itself. These adapter connectors are two-pole coaxial connector plugs and sockets for which the mechanical connection is effected by the friction of the electrical contact elements which are in mutual contact in a snug fit. Mostly, connector plugs and couplings pursuant to DIN 19003 (German Industrial Standard 19003) are used.

The connection is often interrupted because of an inadvertent and unwanted pulling on the control cable because the friction provides only a very limited holding force.

Conventionally, photo objectives equipped with a central shutter and manufactured by Carl Zeiss include a rubber ring in the socket which increases the friction with a normal connector plug and bridges tolerances.

SUMMARY OF THE INVENTION

It is an object of the invention to provide an adapter connector wherein the mechanical connection between a connector plug and a socket is improved and wherein the holding force is increased.

The adapter connector of the invention is for connecting an insertable connector plug to a receiving socket. The adapter connector includes: a body having an adapter socket defining a hollow cylinder for receiving the insertable connector plug therein; a clamping device for pressing in the hollow cylinder to tightly clamp the insertable connector plug therein; and, the body further having an adapter connector plug provided thereon to include an external cylinder with projecting latch nose for insertion into the receiving socket.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
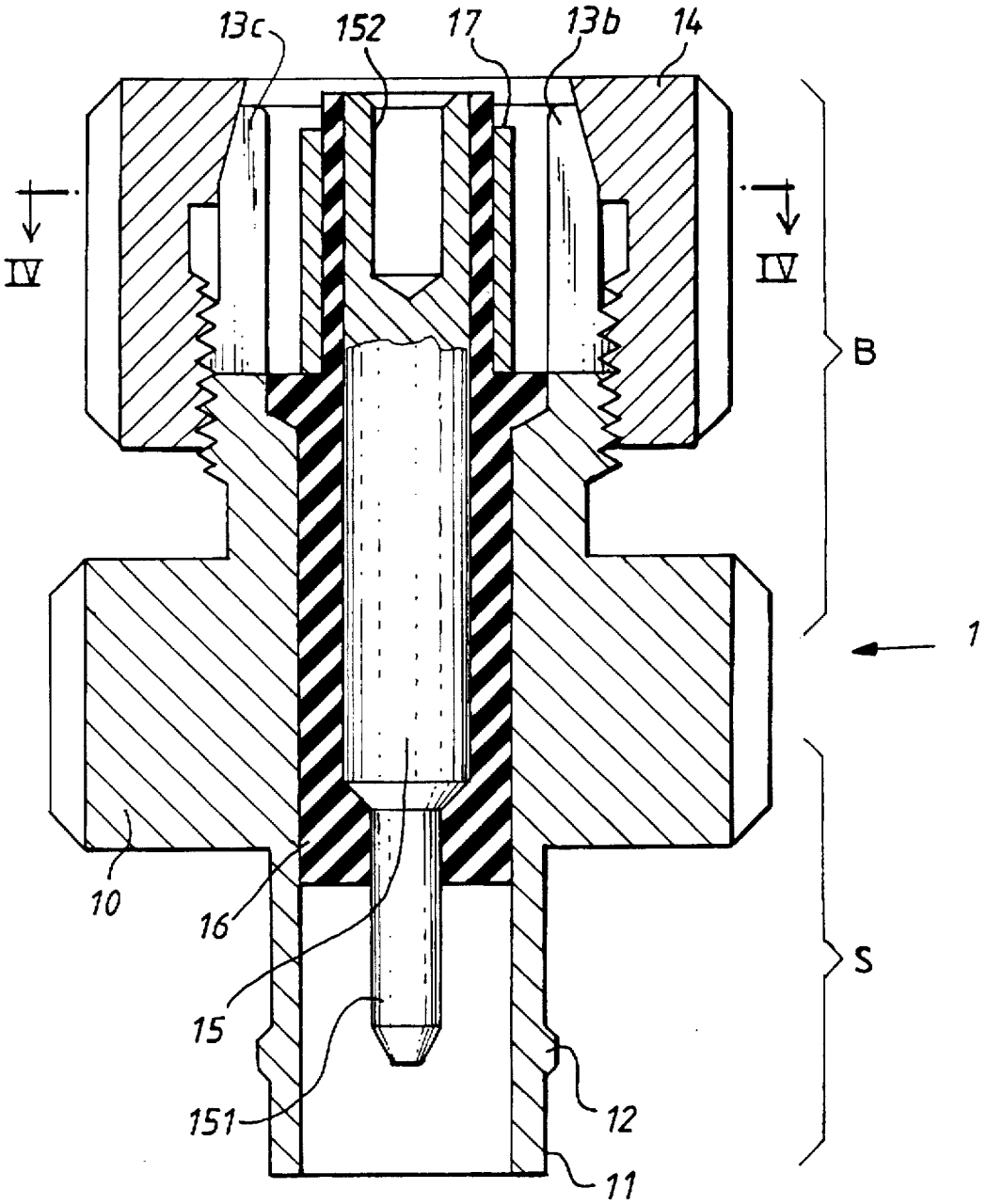
FIG. 1 is a schematic, partially in section, of an adapter connector according to an embodiment of the invention.

The adapter connector 1 shown in FIG. 1 is configured to coact with connector plugs and couplings of conventional type such as in accordance with DIN 19003. The connector plugs and couplings are for flash synchronization control lines. The adapter connector 1 comprises a connector socket B and a connector plug S. The hollow cylinder 13 of the adapter connector 1 defines the mechanical contact surface and the electrical contact surface of the external pole of the socket B. The hollow cylinder 13 can be pressed together by a clamping screw 14 and can then clamp the cylindrical pole shoe of a fitting insertable connector plug (not shown in FIG. 1) inserted into socket B.

A common part 10 is formed as one piece and includes the hollow cylinder 13 and the external cylinder 11 of the connector plug S. The external cylinder 11 includes a peripheral rise which defines a latch cam 12. The pin 15 includes an insulating part 16 with which the pin is centered in the part 10. The pin 15 and insulating part 16 are fixedly seated in part 10. The pin 15 includes a hollow cylinder 152 at the socket end B and a contact pin 151 at the connector plug end S.

Figure 4:
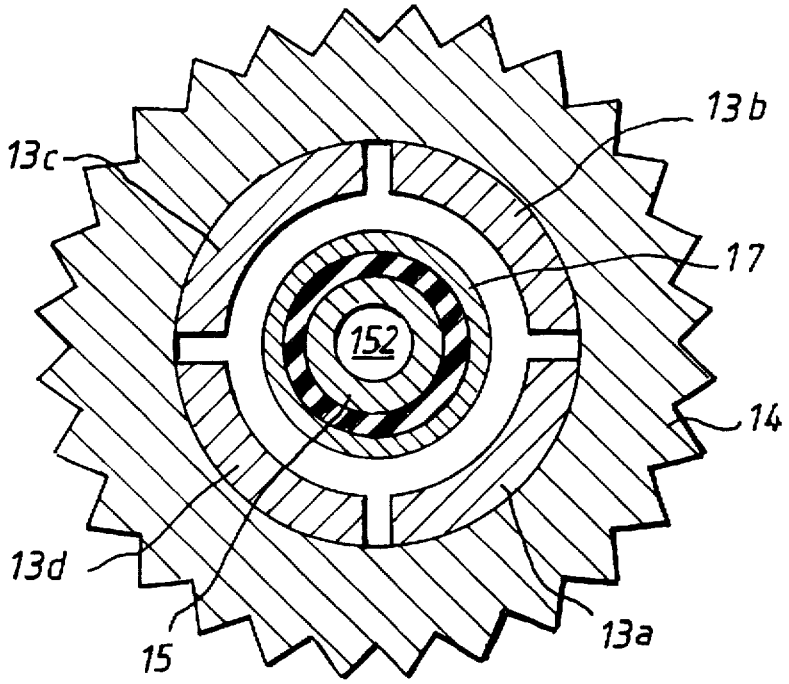

A metal sleeve 17 is pressed onto the insulating part 16 in the region of the hollow cylinder 13. This metal sleeve 17, on the one hand, clamps the pin 15 in the insulating part 16 and, on the other hand, supports the external pole of an insertable connector plug which is clamped in the hollow cylinder 13 as may be required. The hollow cylinder 13 can be provided with a plurality of longitudinal slits to define jaws (13*a* to 13*d*) in the manner of a chuck in order to facilitate clamping. These slits and the jaws (13*a* to 13*d*) can be seen in FIG. 4.

Figure 2:
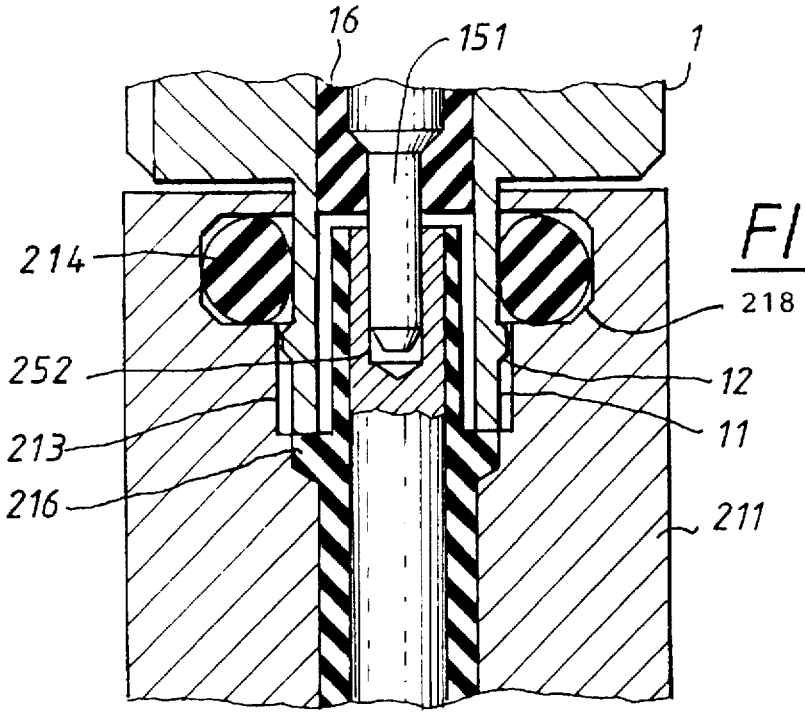
FIG. 2 shows the adapter connector of FIG. 1 with the connector plug thereof inserted into a socket equipped with an elastic ring.

The schematic of FIG. 2 shows the connector plug S of the connector adapter 1 inserted into a socket 211. This socket 211 corresponds substantially to the socket part B of the adapter connector 1 or a socket in accordance with DIN 19003. An elastic or rubber ring 214 is seated in a slot 218 of the hollow cylinder 213. The hollow cylindrical inner contact 252 is attached in the socket 211 with an insulating piece 216. Such a socket 211 is commercially available in photo objectives of Carl Zeiss equipped with a central shutter.

The hollow cylinder 213 of the socket 211 is in friction mechanical (snug fit) and in electrical contact with the peripherally extending latch cam 12 of the adapter connector 1. The elastic ring 214 is disposed on the rearward part of the external cylinder 11 and on the peripherally extending latch cam 12 and, in this way, defines a latch connection of the socket 211 and the adapter connector 1. The holding force of the latch connection is significantly greater than that of the usual snug fit because the rubber ring 214 provides increased friction in the socket 211 which can be easily manually released.

The clamping connection of the socket part B of the connector adapter 1 with a connector plug inserted therein is so configured that the holding force is significantly greater than that of the latch connection of the adapter connector 1 and the socket 211 so that, for routine handling, the connector adapter 1 remains reliably connected to the connector plug and the cable. The routine handling includes connecting and disconnecting the connection between the socket 211 and the cable.

The connector adapter 1 can be inserted into any standard socket without a rubber ring and complete compatibility with standard parts is therefore provided.

Figure 3:
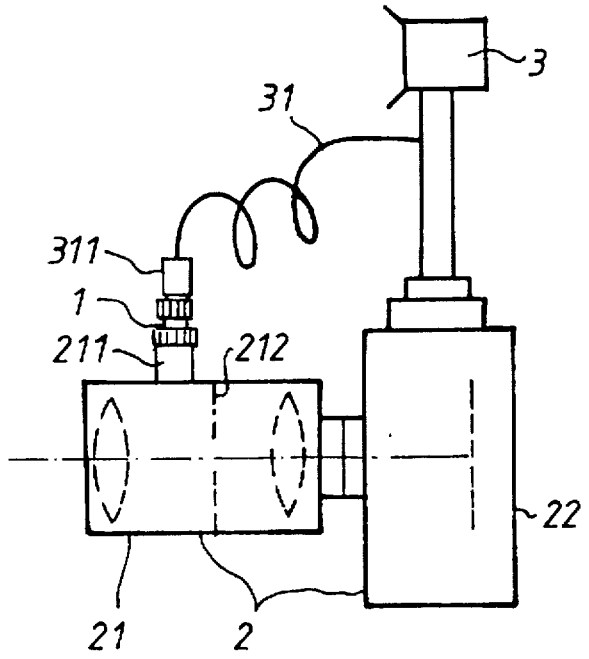
FIG. 3 shows a schematic representation of a camera equipped with the adapter connector of FIG. 1; and, FIG. 4 is a section view taken along line IV—IV of FIG. 1.

The preferred application of the adapter connector 1 according to the invention is shown in FIG. 3 and is in the context of a camera.

A camera 2 includes a housing 22 and an objective 21 having a central shutter 212. A socket 211 according to FIG. 2 is mounted on the objective 21. The flash synchronization signal is applied to the socket 211. A flash device 3 (electronic flash) is connected mechanically to the camera 2 with means known per se. The flash device 3 has a connector cable 31 having a connector plug 311 according to DIN 19003. This connector plug 311 is clamped into the adapter connector 1 and the adapter connector 1 is latched into the socket 211 on the objective 21 as shown in FIG. 2. The cable connection of the camera 2 to the flash device 3 is thereby reliably protected against an unwanted separation.

It is clear that an adapter connector according to the invention is not limited to the dimensioning and use shown in camera technology. Other embodiments, even multipole couplings, are possible. The invention includes a connector plug/socket pair having mechanical holding force provided by friction. A snug fit is provided and supported by an elastic element such as element 214 in the embodiment of FIG. 2. The holding force in the adapter connector of the invention is increased in that a latch cam of the adapter connector provides a latch connection together with the elastic element of the one element (such as element 211) of the socket/plug pair (for example, elements 211 and 311 in FIG. 2) and the other element (for example, element 311) is clamped at the adapter connector 1.

It is understood that the foregoing description is that of the preferred embodiments of the invention and that various changes and modifications may be made thereto without departing from the spirit and scope of the invention as defined in the appended claims.

What is claimed is:

1. An adapter for receiving an insertable connector plug therein and, in turn being insertable into a receiving socket, the adapter comprising:

an elongated body having first and second longitudinal ends;

said elongated body having an adapter socket defining a hollow cylinder formed on said first longitudinal end thereof for receiving the insertable connector plug therein;

a clamping device for exclusively engaging and pressing in said hollow cylinder to tightly clamp the insertable connector plug therein;

said elongated body further having an adapter connector plug formed on said second longitudinal end and said adapter connector plug including an external cylinder with a projecting latch nose for insertion into the receiving socket;

said elongated body defining a first central through bore;

an elongated insulating part fixedly seated in said first central bore and said insulating part defining a second bore coaxial with said first central bore;

a connector pin disposed in said second central bore;

the insertable connector plug being part of a commercially available control line of a flash device of a camera assembly and the receiving socket being mounted on the camera assembly; and, said adapter being compatible with the insertable connector plug and the receiving socket.

2. A camera assembly comprising:

a camera having a housing and an objective;

a two-pole coaxial receiving socket mounted on said camera;

said receiving socket defining a hollow cylinder having an elastic ring seated therein;

a flash device having a control cable equipped with an insertable connector plug adapted to be insertable into said receiving socket;

an adapter connector including:

a body having an adapter socket defining a hollow cylinder for receiving the insertable connector plug therein;

a clamping device for pressing in said hollow cylinder to tightly clamp the insertable connector plug therein; and, said body further having an adapter connector plug provided thereon to include an external cylinder with a projecting latch nose for insertion into the receiving socket.

3. The camera assembly of claim 2, said adapter socket and said adapter connector plug being configured so as to be matched to each other.

4. The camera assembly of claim 3, wherein the receiving socket corresponds substantially to said adapter socket and has a hollow cylinder defining an inside wall surface for receiving said latch nose in contact engagement therewith when said adapter connector plug is inserted therein.

5. The camera assembly of claim 4, wherein said contact engagement is simultaneously both a mechanical contact and an electrical contact.

6. The camera assembly of claim 2, wherein said adapter connector has electrical contacts.

7. The camera assembly of claim 2, wherein said adapter socket and said adapter connector plug both are coaxial connectors.

8. The camera assembly of claim 2, wherein the insertable connector plug is part of a commercially available control line of a flash device of a camera assembly and the receiving socket being mounted on the camera of the camera assembly; and, wherein said adapter connector is compatible with the insertable connector plug and the receiving socket.

9. An adapter for receiving an insertable connector plug therein and, in turn, being insertable into a receiving socket, the adapter comprising:

a body having an adapter socket defining a hollow cylinder for receiving the insertable connector plug therein;

a clamping device for pressing in said hollow cylinder to tightly clamp the insertable connector plug therein;

said body further having an adapter connector plug provided thereon to include an external cylinder with a projecting latch nose for insertion into the receiving socket;

said hollow cylinder defining a longitudinal axis; said clamping device being configured to apply a clamping force to said cylinder in a direction transverse to said longitudinal axis thereby tightly clamping said insertable connector plug in said hollow cylinder;

said hollow cylinder being configured to yield toward said longitudinal axis in response to said clamping force thereby tightly clamping said insertable connector plug in said hollow cylinder; and, said hollow cylinder having a plurality of longitudinal slits formed therein to form a plurality of jaws to facilitate clamping said insertable connector plug.

* * * * *